US005961807A

United States Patent [19]

Daum et al.

[11] Patent Number: 5,961,807

[45] Date of Patent: Oct. 5, 1999

[54] MULTIPART ELECTRICAL SEAL AND METHOD FOR ELECTRICALLY ISOLATING A METALLIC PROJECTION

[75] Inventors: Dennis A. Daum; Timothy L. Arney, both of Cincinnati, Ohio

[73] Assignee: General Electric Company, Cincinnati, Ohio

[21] Appl. No.: 08/962,127

[22] Filed: Oct. 31, 1997

[51] Int. Cl.[6] ..... C25D 5/02

[52] U.S. Cl. ..... 205/136; 205/118

[58] Field of Search ..... 205/118, 136; 204/263

[56] References Cited

U.S. PATENT DOCUMENTS

| | | | |
|---|---|---|---|
| 2,029,011 | 1/1936 | Bart | 205/136 |
| 3,835,017 | 9/1974 | Mentone et al. | 205/136 |
| 4,170,524 | 10/1979 | Nakajyo et al. | 204/15 |
| 5,374,345 | 12/1994 | Owada | 205/118 |
| 5,486,281 | 1/1996 | Gruver et al. | 205/110 |
| 5,534,126 | 7/1996 | Stadler et al. | 205/101 |
| 5,702,574 | 12/1997 | Foster et al. | 204/224 R |

*Primary Examiner*—Arun S. Phasge
*Assistant Examiner*—Erica Smith-Hicks
*Attorney, Agent, or Firm*—Andrew C. Hess; Gerry S. Gressel

[57] ABSTRACT

A multipart seal is provided for electrically isolating from an electrolyte medium a projection secured at a projection base with a body surface, the projection and body surface having different electrochemical activities. A first seal part is a hollow cap sized and shaped to receive and cover the projection and to conform with the projection base. A second seal part is a cured, pliable sealant disposed on a cap wall about a cap opening and cap rim portion, and bonded with and covering the projection base and the body surface surrounding and immediately adjacent to the projection base. Both the first and second seal parts substantially will not react with or allow passage there through of the electrolyte medium. In an electrolytic method to coat the body surface, the projection is electrically isolated with the multipart seal prior to application of the electrolytic coating.

14 Claims, 1 Drawing Sheet

MULTIPART ELECTRICAL SEAL AND METHOD FOR ELECTRICALLY ISOLATING A METALLIC PROJECTION

BACKGROUND OF THE INVENTION

The Government has rights in this invention pursuant to Contract F33657-95C-0055 awarded by the Department of the Air Force.

This invention relates to application of a coating to a metallic article using an electrolytic method; and, more particularly, to an electrical seal on the article and to a method for electrically isolating an article projection from an electrolyte used in the coating method.

Certain turbine engine components, such as gear boxes and other articles which are not exposed to the relatively high temperatures experienced in other parts of the engine, have been manufactured from such metallic materials as Al, Mg or their alloys. To provide article surfaces of such materials with environmental resistance, various types of coatings have been applied to the article surfaces. One type of such coatings is an electrolytic surface conversion type coating, forms of which have been applied commercially for many years, for example, an HAE conversion coating for Mg or Mg base alloys, and anodizing for Al or Al base alloys. In that type of well known process, the article, connected as an electrode, is contacted by or immersed in an electrolyte medium and a protective surface is developed electrolytically on the article. The conversion type coating can be used alone or as a first coating beneath one or more superimposed coatings.

Frequently, such articles as gear boxes and similar casings include various projections such as threaded studs, bolts, and guide pins to enable the article to be joined or aligned with cooperating articles. Such projections, which are secured within the article by threading, interference press fitting, etc., frequently are made of a metal or alloy different from and generally stronger than the material of the article. Typically, such projections can be made of Fe, Ni, Co, or their alloys, for example the commercial Fe based 300 or 400 series stainless steels. From an electrolytic viewpoint, the projections are more noble and are herein defined as having an electrochemical activity in an electrolyte medium less than the electrochemical activity of the material of the article. Repair, including electrolytic recoating, of an article of a first material which includes projections of a second material more noble than the first material can present problems relating to deterioration or burning of the material of the body, for example a Mg alloy, as a result of electrical arcing between the body and the projection, for example stainless steel, during electrolytic coating. To avoid such problems, it has been a practice to destructively remove all projections of a second material prior to electrolytic recoating and replacing them after the electrolytic coating. For example, in the repair of a Mg base alloy casing, all stainless steel projections have been removed destructively and replaced with new projections after processing. As can be appreciated, this is a very labor intensive and relatively costly procedure.

BRIEF SUMMARY OF THE INVENTION

The present invention, in one form, provides a multipart seal for electrically isolating a projection from a body surface of a body and secured with the body at a projection base. The body is of a first metal having a first electrochemical activity, and the projection is of a second metal having a second electrochemical activity less than the first electrochemical activity. The multipart seal comprises a first seal part sized to cover the projection and comprising an electrically non conductive, hollow cap defined by a cap wall of a material which substantially will not react with an electrolyte medium and through which the electrolyte medium cannot pass. The cap includes a cap opening shaped to receive the projection, the cap opening including an opening rim portion generally shaped to conform with the projection base. The seal includes a second seal part comprising an electrically non conductive, cured pliable sealant of a material which substantially will not react with the electrolyte medium and through which the electrolyte medium cannot pass. The sealant is disposed on the cap wall about the cap opening and the cap rim portion, and bonded with and covering the projection base and the body surface surrounding and immediately adjacent to the projection base.

According to the method of the present invention, the multipart seal is used in a method for applying an electrolytic coating to the body surface connected as an electrode in an electrolyte medium to electrically isolate the projection from the electrolyte medium prior to applying the electrolytic coating.

DETAILED DESCRIPTION OF THE INVENTION

One article evaluated in connection with the present invention was an aircraft gas turbine engine accessory gearbox cast from a magnesium base alloy commercially available as QE22 alloy. During original manufacture, the surface of the casting was coated electrolytically with the conversion coating commercially known as HAE coating. After complete coating, various stainless steel projections such as threaded studs and guide pins were secured in appropriate openings or recesses in the casting. In some cases, the projections were secured with locking or holding means, such as stainless steel lock rings, carried between the balance of the projection and the body of the casting. As used herein, the meaning of the term "projection" is intended to include any locking or holding means, such as a lock ring, key lock, twist lock, etc., and associated hardware used to secure the projection with the body of the article.

After the coated gear box had been assembled and operated for a time in a gas turbine engine, it became desirable to repair the casting including the coating. During preparation for repair, the original HAE coating was stripped from the casting surface, for example with a hot caustic liquid, by grit blasting, etc., to provide a clean surface for further processing. As was mentioned above, it had been observed previously that the presence of such projections of a metal more noble than the Mg alloy casting in which they were embedded, during the recoating of the electrolytic conversion HAE coating in an electrolyte medium used for such coating, resulted in electrical arcing between the Mg alloy casting and the projection, and burning of the Mg alloy. Therefore, to avoid such adverse reaction it had been a practice prior to the present invention to remove destructively the projections, including associated hardware such as locking or holding means, from the casting prior to HAE coating. Such destructive removal generally was by grinding, drilling, machining, etc. Then new, replacement projections, including any associated hardware, were attached after recoating. The present invention eliminates the need for such very labor intensive and costly projection removal by providing a multipart seal for electrically isolating the projection, including associated holding or locking hardware, during electrolytic type coating.

Figure 1:
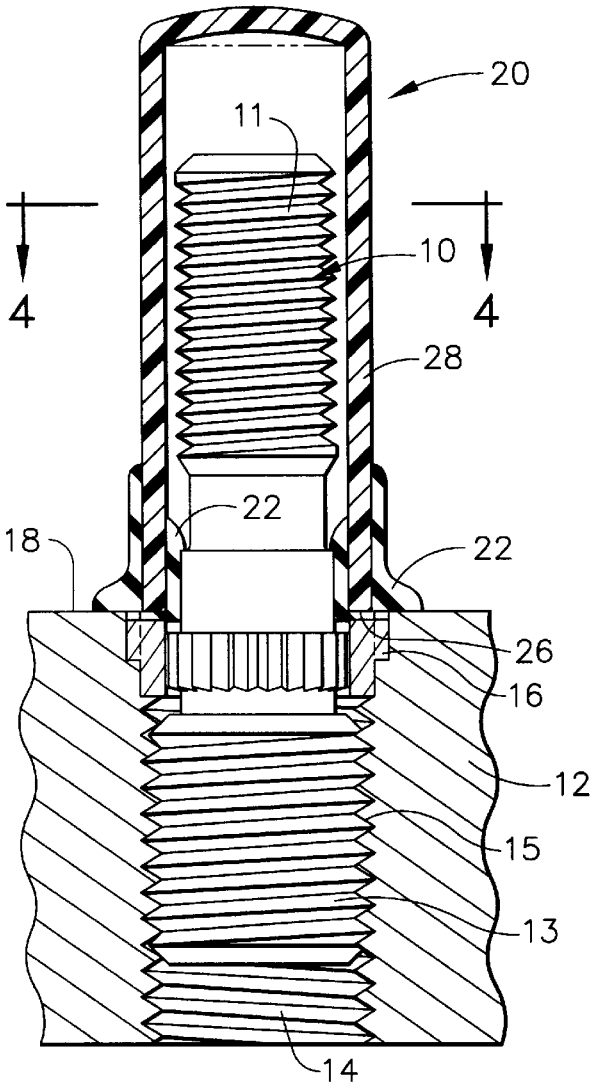
FIG. 1 is a partially sectional, fragmentary view of the seal of the present invention disposed over a projection from a body surface.

The present invention will be more clearly understood by reference to the drawing. FIG. 1 is a partially sectional, fragmentary view of one form of the seal of the present invention disposed over a projection from a body surface. In FIG. 1, a projection shown generally at 10 in the form of a single piece stainless steel threaded stud comprising a first projection portion 11 which protrudes from a cast body 12, and a second projection portion 13 which is secured within blind hole 14 by threads 15 in a QE 22 Mg alloy cast body 12. Assisting in securing projection 10 in hole 14 is a stainless steel locking ring 16. Locking ring 16 also is shown in the diagrammatic, partially sectional, fragmentary plan view of FIG. 4, which shows the assembly of FIG. 1 taken along lines 4—4 without the sealant to show the relative positions of the members. Single piece projection 10 is secured at and protrudes from body surface 18, with the locking ring 16 about second projection portion 13 together defining the projection base adjacent body surface 18.

Figure 2:
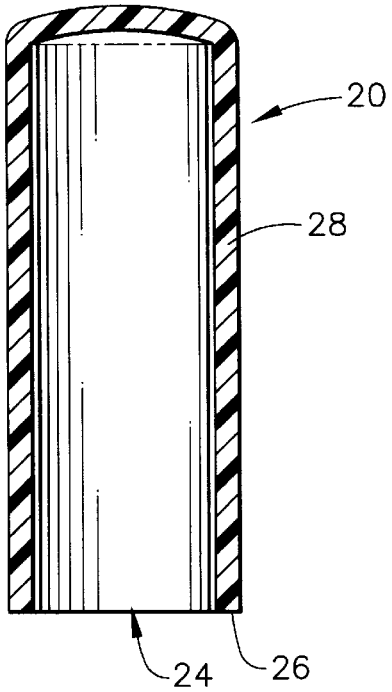
FIG. 2 is a sectional view of the cap of the seal of the present invention.

One form of the multipart electrically isolating seal of the present invention comprises the combination of a hollow cap shown generally at 20 in FIGS. 1 and 2 as a first seal part and a pliable, cured sealant 22 shown in FIG. 1 as a second seal part. The materials of both the cap and the sealant are electrically non conductive, will not react with an electrolyte medium to be used to recoat the body surface 18 and will not allow passage there through of the electrolyte medium.

Figure 4:
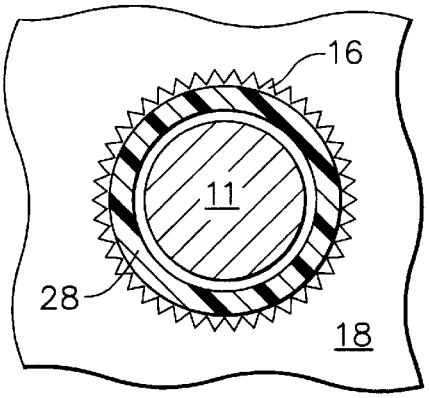
FIG. 4 is a fragmentary, partially sectional diagrammatic plan view of the assembly of FIG. 1, taken along lines 4—4, without the sealant to show the relative positions of the members.

With reference to FIGS. 1 and 2, cap 20 was molded from a nonmetallic material and sized to cover the projection as shown in FIG. 1. Cap 20 includes a cap opening 24, which is shaped to receive projection portion 11 and is defined by an opening rim portion 26 at an end of cap wall 28. Opening rim portion 26 generally is shaped to conform with the projection base, which includes locking ring 16 about projection second portion 13. It is preferred that the rim opening portion 26 be sized to provide a snug or interference fit with the first projection portion 11 adjacent locking ring 16, as represented in FIG. 4.

Sealant 22 in the uncured condition is a flowable, curable material which can flow such as by gravity from cap wall 28 and cap rim 26 to cover the projection base, including locking ring 16, and the body surface 18 surrounding and immediately adjacent to the projection base. Sealant 22 extends over the body surface immediately adjacent the projection base to provide a complete 360° seal around the projection base and over the immediately adjacent body surface, as shown in FIG. 1. Then the sealant is cured to provide a pliable, for example polymeric, structure and completes the electrical isolating seal. Such curing can include heating, catalyzing, aging, etc. to provide the pliable structure. Curing provides a bond between the sealant, the projection including locking ring 16, and the adjacent the body surface 18, thereby electrically isolating the projection, including its associated hardware such as locking ring 16, from an electrolyte medium. Potential arcing between the projection and the body thereby is prevented during subsequent electrolytic coating.

In one specific example during evaluation of the present invention, an aircraft gas turbine engine accessory gear box cast from a Mg base alloy commercially available as QE22 alloy had been coated with commercial HAE surface conversion coating as a first coating over which had been applied a primer coating and a top paint coating, both of epoxy material. The gear box had been assembled and operated in an engine. Inspection disclosed that it was desirable to repair corrosion of the metal of the casting. Removal of the coating combination, including the HAE coating, included immersion in a hot caustic paint stripping bath, after which the gear box was rinsed with water. Then the gear box was grit blasted with plastic media grit to remove paint and/or HAE coating not removed by the stripping process, and steam cleaned to remove any surface contaminants.

Appropriately sized and shaped molded vinyl material caps called Caplug caps, marketed by Protective Closures Company, Inc. were used as the first seal part of the present invention. For example, one series of caps were substantially circular in cross section as shown in FIGS. 1 and 2, were about 1.5" in total length and were of 4 different diameters to provide a snug fit around the various size projections particularly at the juncture of the projection base with the body surface of the casting. Although vinyl material was used in this example, it should be understood that other electrically non conductive materials which substantially will not react with or allow passage there through of an electrolyte medium used in subsequent electrolytic coating can be used. Such materials include other solid polymeric materials, glass, rubber, etc.

To provide the second seal part of the present invention, the caps at their rim portions of the cap walls were dipped in a container of a flowable, electrically non conductive, curable sealant in the form of a fast curing vinyl rubber liquid insulating product called Liquid Electrical Tape marketed by Star Brite Company, as a non silicone product required for this type of application. Such material is curable to an electrically non conductive material substantially impervious to and non reactive with the electrolyte medium used in HAE coating. The caps were dipped into the liquid sealant to a cap wall depth, from the cap opening, which, based on the viscosity of the liquid, would allow flow of the liquid sealant by gravity down the cap wall, onto the projection base at its juncture with the body surface of the casting, and onto the body surface, at least covering the projection base and the body surface surrounding and immediately adjacent to the projection base. In this specific example for the cast gear box and the size caps used, it was found that dipping the cap walls in the above type of sealant to a depth of 0.2" did not provide adequate electrical protection from burning during coating, and that dipping to a depth of 0.5" resulted in too much flow of sealant onto the body surface. Therefore, one preferred form of the method of the present invention is to dip the cap wall in the sealant to a depth which is greater than 0.2" and less than 0.5". In this specific example, the cap wall was dipped into the sealant to a depth of about 0.3–0.4"

After dipping the caps in the sealant, the caps were disposed over the projections with the rim portion in contact with the base of the projection, as shown in FIG. 1. In order to provide good wetting of the sealant and the juncture of the projection with the casting body surface, particularly when a locking ring or similar hardware is a part of the projection, the cap rim portion when in position over the projection was rotated in respect to the body surface. Rotation of the cap of about one half to three quarters of a turn has been found to be adequate to provide a complete seal around the base of the projection. The type of sealant used in this example was observed to skin over in about 5–7 minutes, allowing free movement of the casting. In order not to inhibit subsequent HAE coating of the body surface of the casting adjacent the projection, any excess or spilled vinyl sealant then can be cleaned easily from the body surface. In this example, the sealant was allowed to cure for about 4 hours. When installed properly, after curing there will be a relatively heavy fillet of vinyl sealant around the base of each projection as described above, forming a tight seal and, in combination with the cap, protecting the projections from the electrolyte medium used in an electrolytic coating process such as HAE coating.

Figure 3:
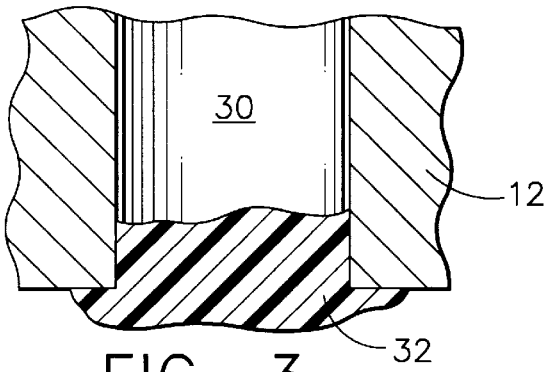
FIG. 3 is a fragmentary, sectional view of a sealant sealed opening of a through hole form of the body of FIG. 1 beneath the projection.

In some instances, the holes in which the projections are carried were through holes 30, as shown in the fragmentary sectional view of FIG. 3, opening to another portion or externally of the article. In such an example, in order to prevent electrolyte medium from passing within hole 30 and contacting the second projection portion 13, a small amount of the above described sealant was applied to the rear of hole 30 to provide the barrier seal 32 as shown in FIG. 3.

After the above described preparation of the casting, the HAE electrolytic conversion coating was applied to the body surface of the casting without electrical arcing between the stainless steel projections and the Mg alloy body as a result of use of the present invention. After coating, the casting was rinsed in water and the caps and cured sealant comprising the multipart seal of the present invention were removed by pulling the caps and bonded sealant from the projections. Any sealant adhering to the projection base and/or body surface was removed easily with a tweezers.

The present invention has been described in connection with various specific examples, embodiments and combinations. However, it will be understood by those skilled in the arts involved that this invention is capable of a variety of modifications, variations and amplifications without departing from its scope as defined in the appended claims.

We claim:

1. In a method for coating an article which comprises a body, including a body surface, of a first metal having a first electrochemical activity; and a projection from the body surface and secured with the body at a projection base, the projection being of a second metal having a second electrochemical activity less than the first electrochemical activity; in which method a coating is applied electrolytically to the body surface, including a body surface portion adjacent to the projection base, with the body connected as an electrode in an electrolyte medium; the steps of:

electrically isolating the projection from the electrolyte medium with a multipart seal comprising:

a) a first seal part sized to cover the projection and comprising an electrically non conductive, hollow cap defined by a continuous cap wall enclosing a hollow interior and of a material which substantially will not react with the electrolyte medium and through which the electrolyte medium cannot pass, the cap including a single cap opening shaped to receive the projection, the single opening including an opening rim portion generally shaped to conform with the projection base; and, b) a second seal part comprising an electrically non conductive, cured pliable sealant of a material which substantially will not react with the electrolyte medium and through which the electrolyte medium cannot pass, disposed on the cap wall about the single cap opening and the cap rim portion, the sealant being bonded directly with and covering the projection base and the body surface surrounding and immediately adjacent to the projection base; and, applying the coating electrolytically to the body.

2. The method of claim 1 in which electrically isolating the projection comprises:

providing the first seal part;

providing, for the second seal part, the sealant in the form of an uncured flowable, curable sealant;

applying the uncured sealant to the cap wall about the cap opening and the cap rim portion;

disposing the cap and uncured sealant over the projection with the uncured sealant in continuous contact with the projection base and the body surface surrounding and immediately adjacent to the projection base; and, curing the uncured sealant to bond the sealant with the projection base to provide the multipart seal and to electrically isolate the projection.

3. The method of claim 2 in which applying the sealant to the cap wall is by dipping the cap wall into the sealant to a depth from the cap opening which, based on viscosity of the uncured sealant, will allow flow of the sealant by gravity down the cap wall, onto the projection base at its juncture with the body surface, and onto the body surface, to provide the sealant in the shape of a fillet between the cap wall and the body surface at least covering the projection base and the body surface surrounding and immediately adjacent to the projection base.

4. The method of claim 2 in which the uncured sealant is applied to the cap wall by dipping the cap wall into the sealant to a depth of greater than 0.2" and less than 0.5".

5. The method of claim 4 in which the depth is about 0.3–0.4".

6. The method of claim 2 in which the second seal part is a non silicone material.

7. A multipart seal for electrically isolating from an electrolyte medium a projection from a body surface of a body and secured with the body at a projection base, the body being of a first metal having a first electrochemical activity, and the projection being of a second metal having a second electrochemical activity less than the first electrochemical activity, comprising:

a first seal part sized to cover the projection and comprising an electrically non conductive hollow cap defined by a continuous cap wall enclosing a hollow interior and of a material which substantially will not react with the electrolyte medium and through which the electrolyte medium cannot pass, the cap including a single cap opening shaped to receive the projection, the single opening including an opening rim portion generally shaped to conform with the projection base; and, a second seal part comprising an electrically non conductive, cured pliable sealant of a material which substantially will not react with the electrolyte medium and through which the electrolyte medium cannot pass, disposed on the cap wall about the single cap opening and the cap rim portion, the sealant being bonded directly with and covering the projection base and the body surface surrounding and immediately adjacent to the projection base.

8. The seal of claim 7 in which the second seal part is a non silicone material.

9. In a method for applying a coating to an article which comprises a body, including a body surface, the body being of a first metal selected from the group consisting of Al, Mg, and their alloys and having a first electrochemical activity; and a projection from the body surface, the projection being of a second metal selected from the group consisting of Fe, Ni, Co, and their alloys, and having a second electrochemical activity less than the first electrochemical activity, the projection being secured with the body at a projection base; in which method a coating is applied electrolytically to the body surface, including a body surface portion adjacent to projection base, with the body connected as an electrode in an electrolyte medium; the steps for electrically isolating the projection from the electrolyte medium with a multipart seal prior to applying the coating to the article of:

providing a first seal part consisting essentially of an electrically non conductive, hollow cap defined by a continuous cap wall enclosing a hollow interior and of a plastic material which will not react with the electrolyte medium and through which the electrolyte medium cannot pass, the cap sized to cover the projection and including a single cap opening shaped to receive the projection, the opening including an opening rim portion shaped to conform with and provide substantially an interference fit with the projection base;

providing an uncured flowable, curable sealant of an electrically non conductive material which will not react with the electrolyte medium and through which the electrolyte medium cannot pass;

disposing the uncured sealant on the cap wall of the first seal part adjacent and about the cap rim portion;

disposing the first seal part over the projection so that the projection is within the hollow interior of the first seal part and the cap rim portion is at the body surface portion adjacent the projection base, with the uncured flowable sealant in continuous contact with the projection base and with the body surface portion surrounding and immediately adjacent the projection base; and, curing the uncured sealant to bond the sealant with the cap wall of the first seal part, with the projection base and with the body surface portion surrounding and immediately adjacent the projection base to provide a second seal part which in combination with the first seal part electrically isolates the projection from the electrolyte medium.

10. The method of claim 9 in which the second seal part is in the shape of a fillet between, covering and bonded with the cap wall, the projection base and the body surface surrounding and immediately adjacent to the projection base.

11. A multipart seal for electrically isolating from an electrolyte medium a projection from a body surface of a body and secured with the body at a projection base, the body being of a first metal selected from the group consisting of Al, Mg and their alloys and having a first electrochemical activity, and the projection being of a second metal selected from the group consisting of Fe, Ni, Co, and their alloys and having a second electrochemical activity less than the first electrochemical activity, comprising:

a first seal part consisting essentially of an electrically non conductive, hollow cap defined by a continuous cap wall enclosing a hollow interior and of a plastic material which will not react with the electrolyte medium and through which the electrolyte medium cannot pass, the cap sized to cover the projection and including a single cap opening shaped to receive the projection, the single opening including an opening rim portion shaped to conform with and provide substantially an interference fit with the projection base; and, a second seal part consisting essentially of an electrically non conductive, cured pliable sealant of a material which will not react with the electrolyte medium and through which the electrolyte medium cannot pass, the sealant being disposed on the cap wall about the single cap opening and the cap rim portion in the shape of a fillet between the cap wall and the body surface, the sealant being bonded directly with and covering the projection base and body surface surrounding and immediately adjacent to the projection base.

12. The seal of claim 11 in which:

the projections are substantially circular in cross section and are selected from at least one of the group consisting of studs, bolts and guide pins; and, the first and second seal parts are substantially circular in cross section.

13. The seal of claim 12 in which the projections are of an Fe based alloy.

14. The seal of claim 12 in which the sealant is of a non silicone material.

* * * * *